US005178123A

United States Patent [19]

I-Chih

[11] Patent Number: 5,178,123

[45] Date of Patent: Jan. 12, 1993

[54] DIRECTION-CONTROL DEVICE FOR A TENNIS-BALL SHOOTER

[76] Inventor: Yeh I-Chih, 4th Fl., No. 11, Lane 192, Tingkan St., Sanchung City, Taipei Hsien, Taiwan

[21] Appl. No.: 783,489

[22] Filed: Oct. 28, 1991

[51] Int. Cl.[5] ..... A63B 69/40

[52] U.S. Cl. ..... 124/78; 124/81; 273/29 A

[58] Field of Search ..... 124/78, 81, 1, 9; 273/29 A, 26 D

[56] References Cited

U.S. PATENT DOCUMENTS

| | | | |
|---|---|---|---|
| Re. 28,462 | 7/1975 | Halstead | 124/78 |
| 3,774,584 | 11/1973 | Paulson | 273/26 D X |
| 3,913,552 | 10/1975 | Yarur et al. | 124/78 |
| 4,325,351 | 4/1982 | Yuasa | 124/78 |
| 4,712,534 | 12/1987 | Nozato | 273/26 D X |
| 5,046,476 | 9/1991 | Nozato | 124/78 |

*Primary Examiner*—David H. Corbin
*Assistant Examiner*—Jeffrey L. Thompson
*Attorney, Agent, or Firm*—Robbins, Dalgarn, Berliner & Carson

[57] ABSTRACT

A direction-control device for a tennis-ball shooter having a mount plate on which two motors are mounted for driving two wheels which together control a speed and a spinning extent of a tennis ball to be served. The direction-control device includes a first bar extending along a Z-axis and drivable by a first motor to allow a pivotal movement of the mount plate on a Y-Z plane about an X-axis upon a restricted rotational movement of the first motor, thereby controlling the served tennis ball to fall in front of or behind the practicer. The device-control device further includes a second bar having a first end attached to the mount plate and a second end drivably attached to a second motor to allow a pivotal movement of the mount plate on a Z-X plane about a Y-axis upon a restricted rotational movement of the second motor, thereby controlling the spinning axis of the tennis ball to be served. The direction-control device further includes a third bar having a first end attached to the mount plate and a second end drivably attached to a third motor to allow a pivotal movement of the mount plate on an X-Y plane about the Z axis upon a restricted rotational movement of the third motor, thereby controlling the served ball to fall at a left side or a right side of the practicer.

7 Claims, 8 Drawing Sheets

DIRECTION-CONTROL DEVICE FOR A TENNIS-BALL SHOOTER

BACKGROUND OF THE INVENTION

The present invention relates to a direction-control device for a tennis-ball shooter, and more particularly to a control device which may accurately simulate live shots by controlling speed, left and right angles, up and down angles, and spinning axes of tennis balls for practicing.

Automatic tennis-ball shooters attempt to simulate an actual shot from an opponent. This simulation can be varied by adjusting the speed and direction of the ball, e.g., left, right, up, and down. However, in actual competition, the number of possible shots is much greater than that which can be simulated by these five variables. For example, for the common drop-shot, a player slices the ball to apply excessive back spin thereon. Other shots with top spin and side spins are also common, rotating the tennis ball about any number of axes. These common shots cannot be accurately simulated with current automatic tennis-ball shooters.

Therefore, there has been a long and unfulfilled need for an automatic tennis-ball shooter with a direction-control device which accurately simulates live shots by controlling speed, left and right angles, up and down angles, and spinning axes of tennis balls.

SUMMARY OF THE INVENTION

The present invention provides a direction-control device for a tennis-ball shooter of the type comprising a mount plate on which two motors are mounted on a first side thereof, the motors respectively drive a first wheel and a second wheel provided on a second side of the mount plate opposite to the first side, which together control a speed and spinning extent of a tennis ball to be served.

The direction-control device includes a first bar extending along a Z-axis and drivable by a first motor to allow a pivotal movement of the mount plate on a Y-Z plane about an X-axis upon a restricted rotational movement of the first motor, thereby effecting the controlling of up and down angles of the tennis ball to be served, which decides the served tennis ball to fall in front of or behind the practicer.

In the controlling of the up and down angles of the tennis balls, a mediate portion of the first bar is cut out to form two opposite recesses with a through hole penetrating therethrough. A rotatably mounted shaft extends along an X-axis and has a first end engaged to the recesses of the first bar by means of a pivot pin passing through the through hole, such that the mount plate is pivotable on a Z-X plane about the pivot pin. A second end of the shaft is drivable by the first which is restricted in a rotational movement thereof, such that the mount plate pivots on a Y-Z plane about the X-axis upon a rotational movement of the motor.

The device-control device further includes a second bar having a first end attached to the first side of the mount plate and a second end drivably attached to a second motor which is restricted in a rotational movement thereof, such that the mount plate pivots on the Z-X plane about a Y-axis upon a rotational movement of the second motor, thereby controlling the spinning axis of the tennis ball to be served. The second motor is mounted on a first motor seat which is mounted on the shaft to rotate therewith.

The direction-control device further includes a third bar having a first end attached to the first side of the mount plate and a second end drivably attached to a third motor which is restricted in a rotational movement thereof, such that the mount plate pivots on an X-Y plane about the Z axis, thereby controlling left and right angles of the tennis ball, which effectively decides the served ball to fall on a left side or a right side of the practicer. The third motor is mounted on a second motor seat which is mounted on the shaft to rotate therewith.

Accordingly, it is a primary object of the present invention to provide an automatic tennis-ball shooter with a direction-control device which accurately simulates live shots by controlling speed, left and right angles, up and down angles, and spinning axes of tennis balls.

Other objects, advantages, and novel features of the invention will become more apparent from the following detailed description when taken in conjunction with the accompanying drawings.

BRIEF DESCRIPTION OF THE DRAWINGS

FIGS. 3 and 4 are schematic views showing various positions of a first driving means which controls up and down angles of the tennis balls to be served, in which FIG. 3 is in a rightmost position and FIG. 4 is in a leftmost position;

FIGS. 7 and 8 are schematic views showing various positions of a third driving means whichs control left and right angles of the tennis balls to be served, in which FIG. 7 is in a rightmost position and FIG. 8 is in a leftmost position.

DETAILED DESCRIPTION OF THE PREFERRED EMBODIMENTS

Figure 1:
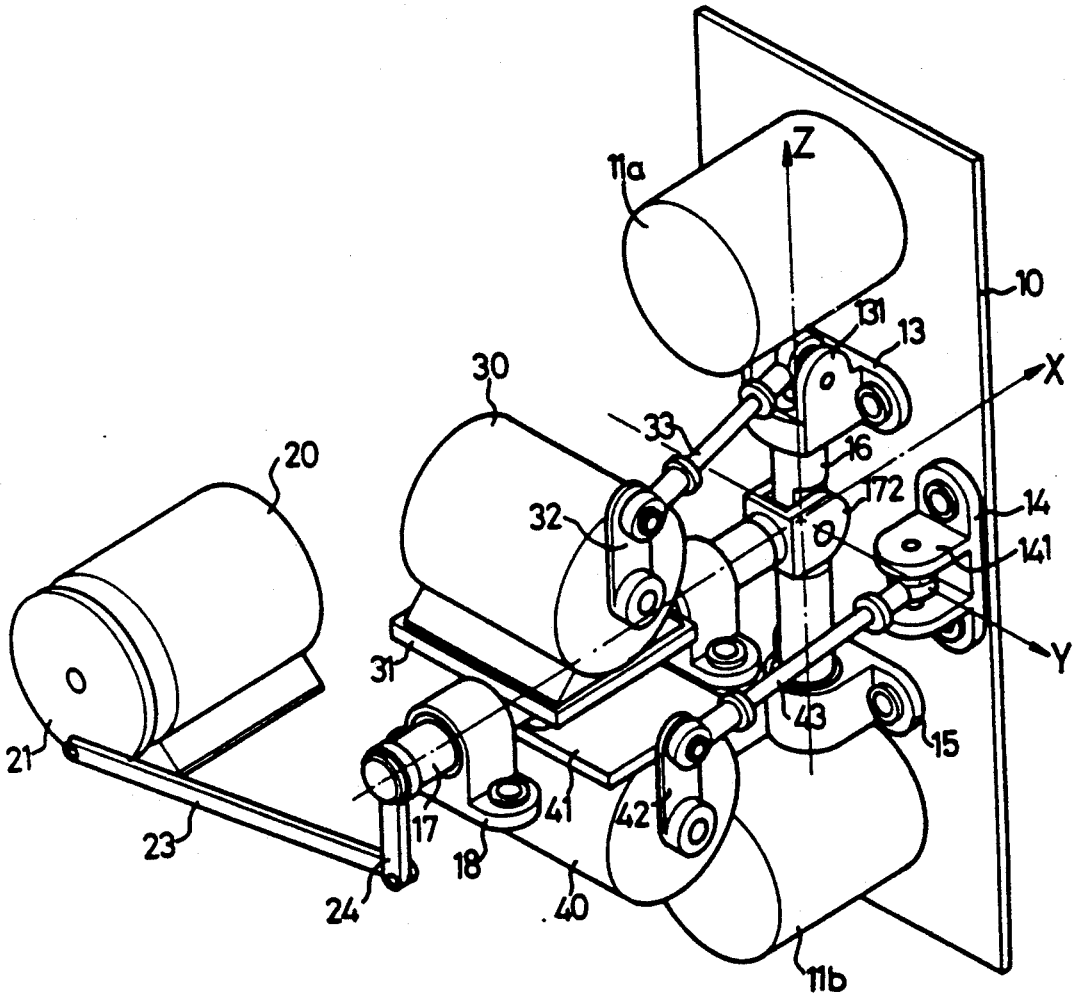
FIG. 1 is a perspective view of a direction-control device for a tennis-ball shooter in accordance with the present invention, in which two wheels for shooting tennis balls are omitted for clarity.
Figure 2:
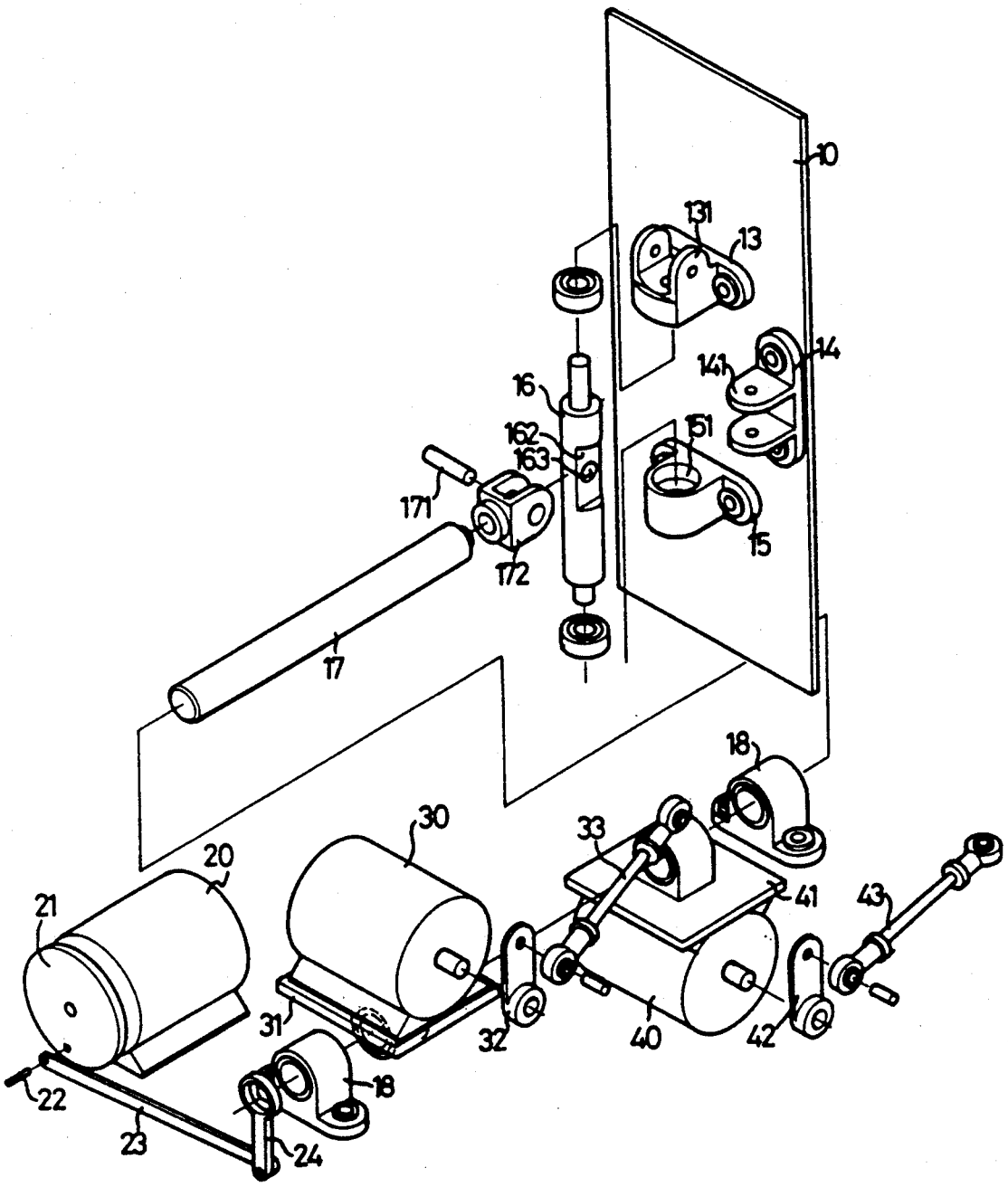
FIG. 2 is an exploded view of the direction-control device in which two motors for driving the wheels are omitted for clarity.

Referring to the drawings and initially to FIGS. 1 and 2, a direction-control device according to the present invention generally includes a mount plate 10 on which two motors 11*a* and 11*b* are mounted on a first side thereof. The motors 11*a* and 11*b* respectively drive a first wheel 12*a* and a second wheel 12*b* provided on a second side of the mount plate 10 opposite to the first side (see FIGS. 5 and 6), which together control the speed and spinning extent of a tennis ball 50 to be served.

An upper seat 13 and a lower seat 15 are respectively mounted on an upper portion and a lower portion of the first side of the mount plate 10 for respectively receiving an upper end and a lower end of a first bar 16 extending along a Z-axis. A mediate portion of the first bar 16 is cut out to form two opposite recesses 162 with a through hole 163 penetrating therethrough. A shaft 17 which extends along an X-axis is rotatably mounted in two mount seats 18. The shaft 17 has a first end 172 engaged with the recesses 162 of the first bar 16 by means of a pivot pin 171 passing through the through hole 163, which will be discussed in detail later. The shaft 17 further has a second end rigidly engaged with a transmission member 24 which engages with another transmission member 23 which is pivotally secured to an output wheel 21 of a first driving means, such as a motor 20. It is noted the output wheel 21 of the first motor 20 is restricted, i.e., the output wheel 21 may move between a leftmost position as shown in FIG. 3 and a rightmost position as shown in FIG. 4.

Figure 3:
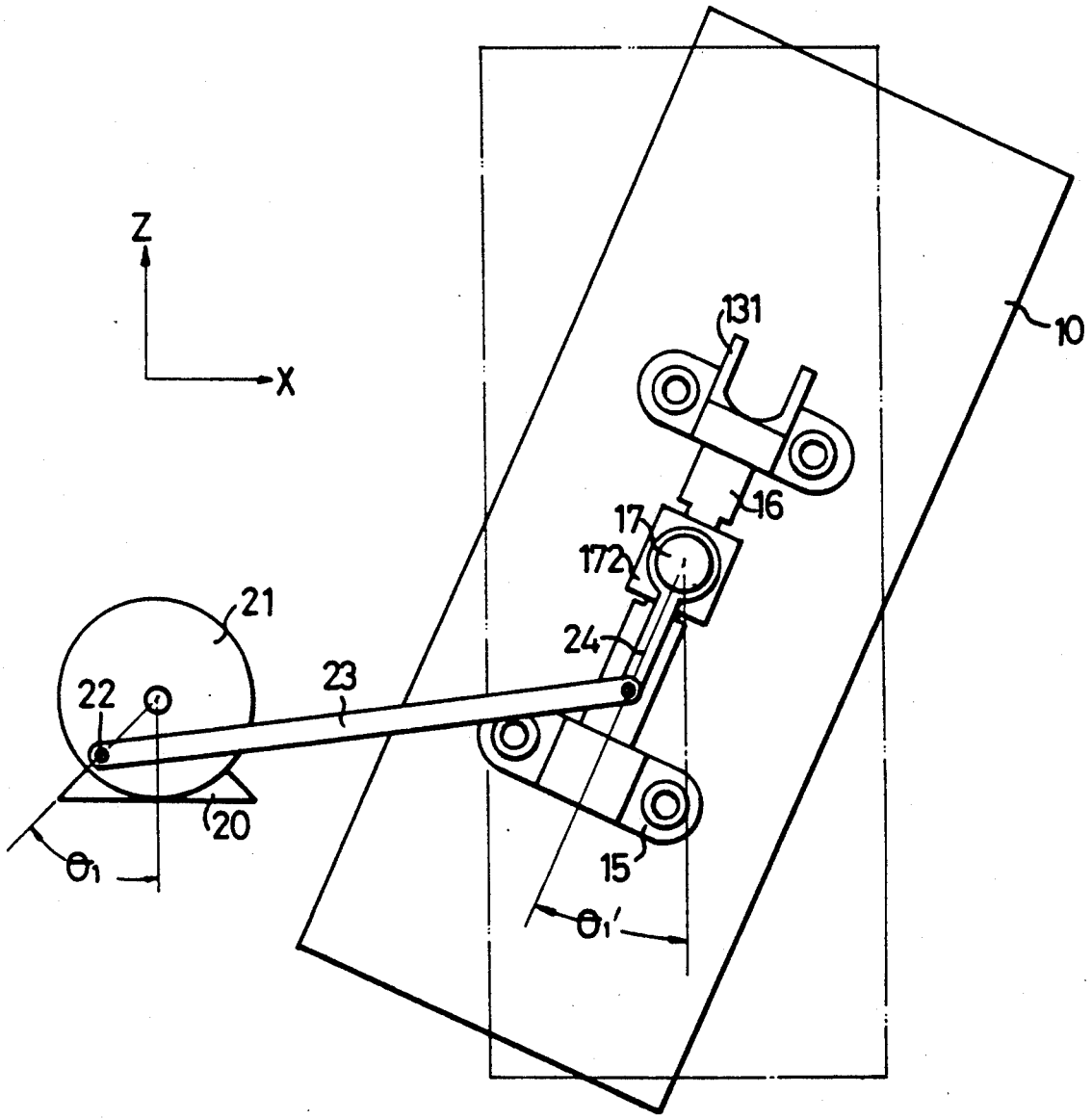
Figure 4:
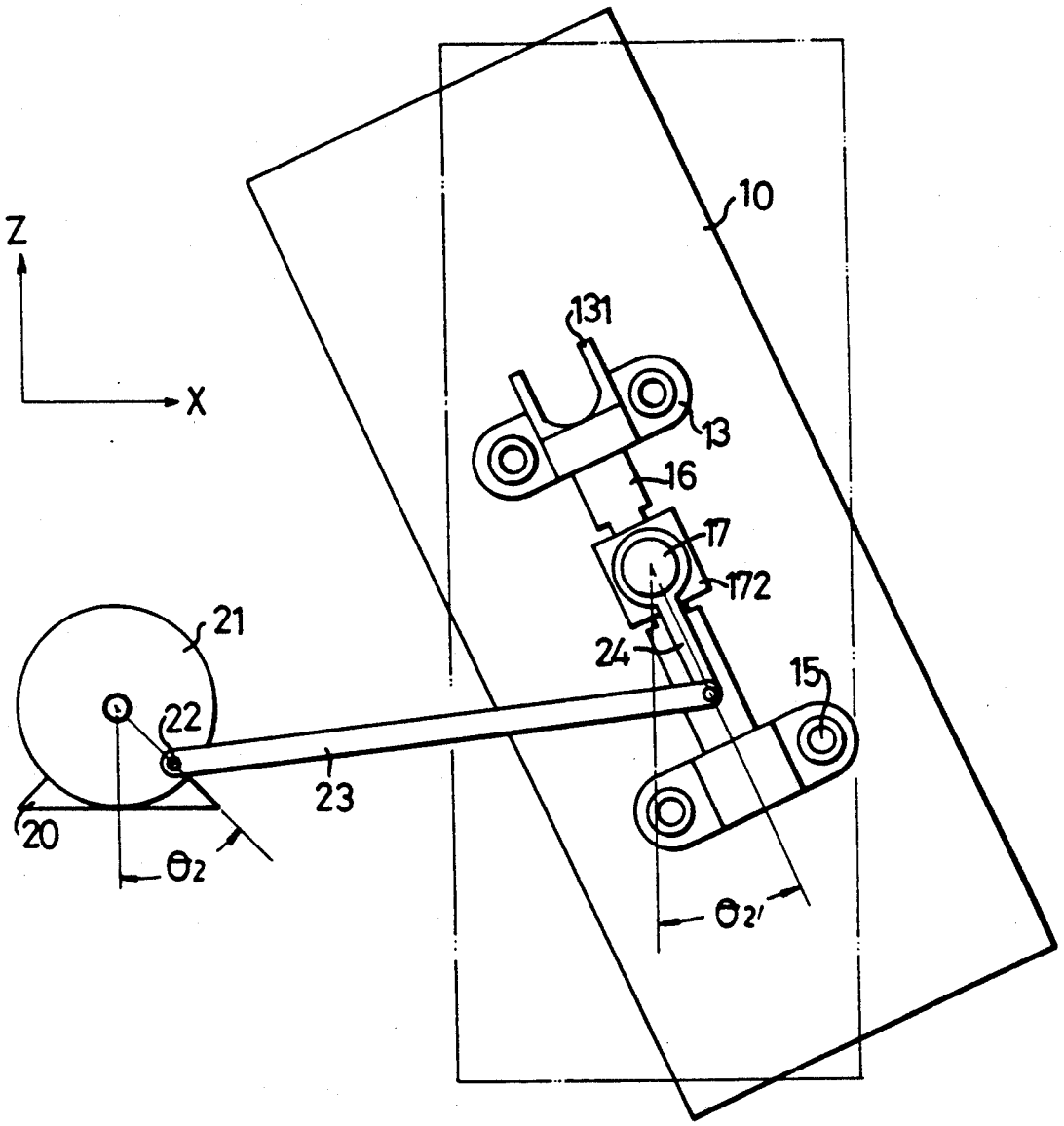

FIGS. 3 and 4 show controlling of up and down angles of the tennis ball 50 to be served. With reference to FIG. 1, when the output wheel 21 is driven by the first motor 20 to rotate clockwise from a position shown in FIG. 1 through a first angle $\theta_1$ to the leftmost position shown in FIG. 3, through the transmission of the transmission members 23 and 24 and the shaft 17, the second end 172 of the shaft 17 "twists" the first bar 16 together with the mount plate 10 to incline forward toward the practicer through an angle of $\theta_1'$ (in this figure, the mount plate 10 pivots clockwise). Conversely, when the output wheel 21 rotates counterclockwise from a position shown in FIG. 1 through a second angle $\theta_2$ to the rightmost position shown in FIG. 4, through the transmission of the transmission members 23 and 24 and the shaft 17, the second end 172 of the shaft 17 "twists" the first bar 16 together with the mount plate 10 to incline rearward away from the practicer of an angle of $\theta_2'$ (in this figure, the mount plate 10 pivots counterclockwise). Accordingly, the served tennis balls can be controlled to fall at a position in front of or behind the practicer. The first and second angles $\theta_1$ and $\theta_2$ can be varied by controlling the first motor 20, and are preferably of a maximum angle of 45°. Angles $\theta_1'$ and $\theta_2'$ can be varied in relation to the transmission members 23 and 24. When a spinning effect is required, the two wheels 12*a* and 12*b* are of different speeds to obtain the required spinning effect.

Referring back to FIGS. 1 and 2, a second bar 33 is attached to the upper seat 13 at a first end thereof and is attached to a second driving means, such as a motor 30 via a member 32 at a second end thereof, and is thus drivable by the second motor 30 to actuate the mount plate to pivot on a Z-X plane about a Y-axis. The member 32 is mounted on an output shaft of the second motor 30 to rotate therewith, and the second end of the second bar 43 is attached to a distal end of the member 32. The second motor 30 is mounted on a motor seat 31 which is mounted on the shaft 17 to rotate therewith.

Figure 5:
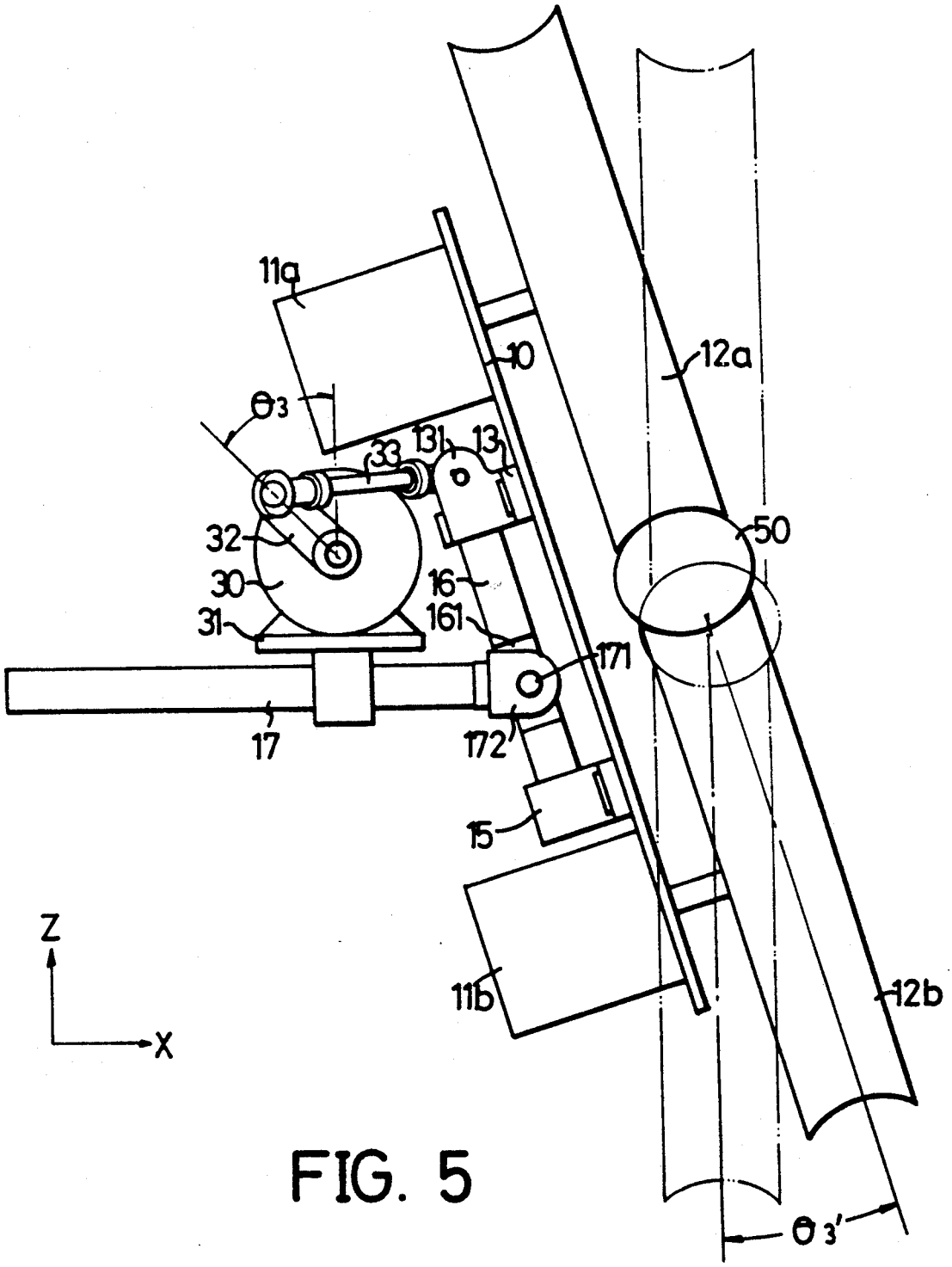
FIGS. 5 and 6 are schematic views showing various positions of a second driving means whichs control various spinning axes of the tennis balls to be served.
Figure 6:
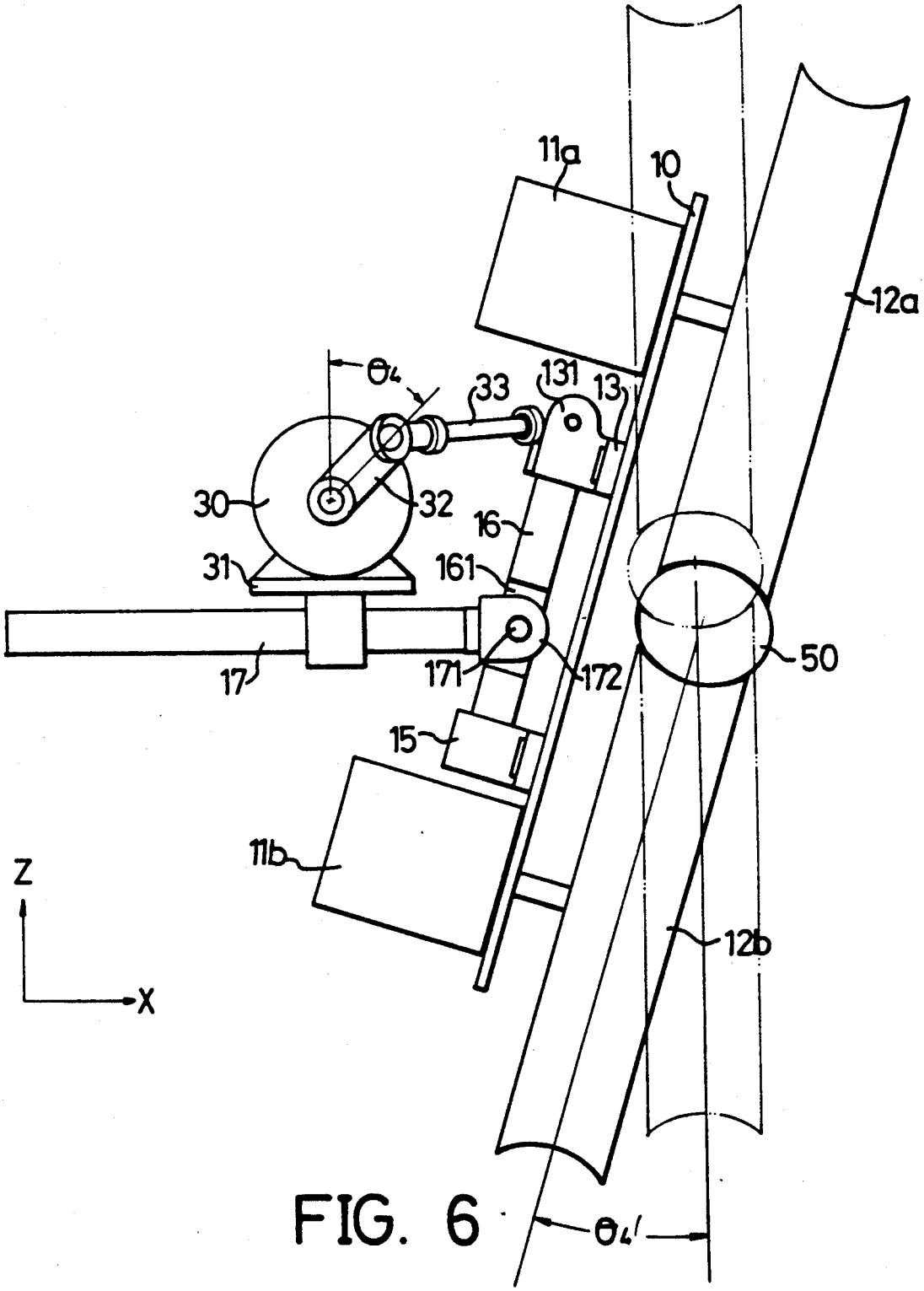

Referring to FIGS. 5 and 6, under the control of the second motor 30, the movement of the second bar 33 is restricted between a leftmost position as shown in FIG. 5 and a rightmost position as shown in FIG. 6. When the second motor 30 rotates counterclockwise from a position shown in FIG. 1 through a third angle $\theta_3$, the second bar 33 moves to the leftmost position shown in FIG. 5. The mount plate 10 pivots on the Z-X plane about the pivot pin 171 (i.e., the Y-axis) to turn the tennis ball counterclockwise, thereby shifting the spinning axis of the tennis ball through an angle of $\theta_3'$. Again, when a spinning effect is required, the two wheels 12*a* and 12*b* are of different speeds to obtain the required spinning effect. Nevertheless, the spinning axis of the tennis ball is shifted through an angle of $\theta_3'$. Conversely, when the second motor 30 rotates clockwise from a position shown in FIG. 1 through a fourth angle $\theta_4$, the second bar 33 moves to the rightmost position shown in FIG. 6. The mount plate 10 pivots on the Z-X plane about the pivot pin 171 to turn the tennis ball clockwise through an angle of $\theta_4'$, thereby shifting the spinning axis of the tennis ball through an angle of $\theta_4'$. Again, a spinning effect can be obtained with the wheels 12 of different speeds. The third and fourth angles $\theta_3$ and $\theta_4$ can be varied by controlling the second motor 30, and are preferably of a maximum angle of 45°. Angles $\theta_3'$ and $\theta_4'$ can be varied in relation to the second bar 33 and the member 32.

Referring back to FIGS. 1 and 2, a third bar 43 is provided to actuate the mount plate 10 to move on an X-Y plane, thereby controlling left and right angles of tennis balls. The third bar 43 has a first end attached to a side seat 14 mounted on the first side of the mount plate 10 and a second end drivable by a third driving means, such as a motor 40 via a member 42. The member 42 is mounted on an output shaft of the motor 40 to rotate therewith, and the second end of the third bar 43 is attached to a distal end of the member 42. The third motor 40 is mounted on another motor seat 41 which is also mounted on the shaft 17 to rotate therewith.

Figure 7:
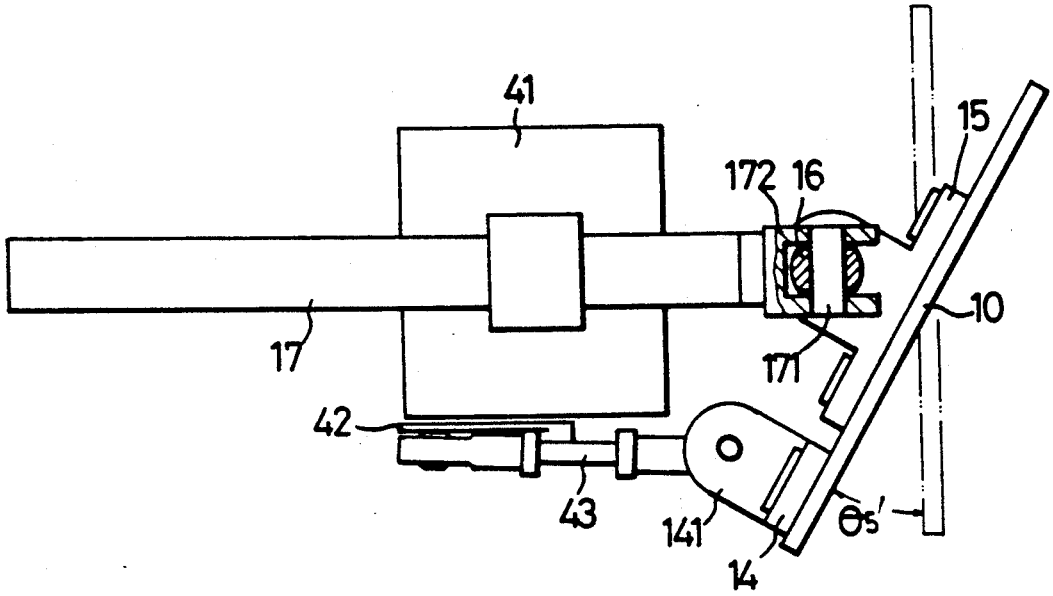
Figure 8:
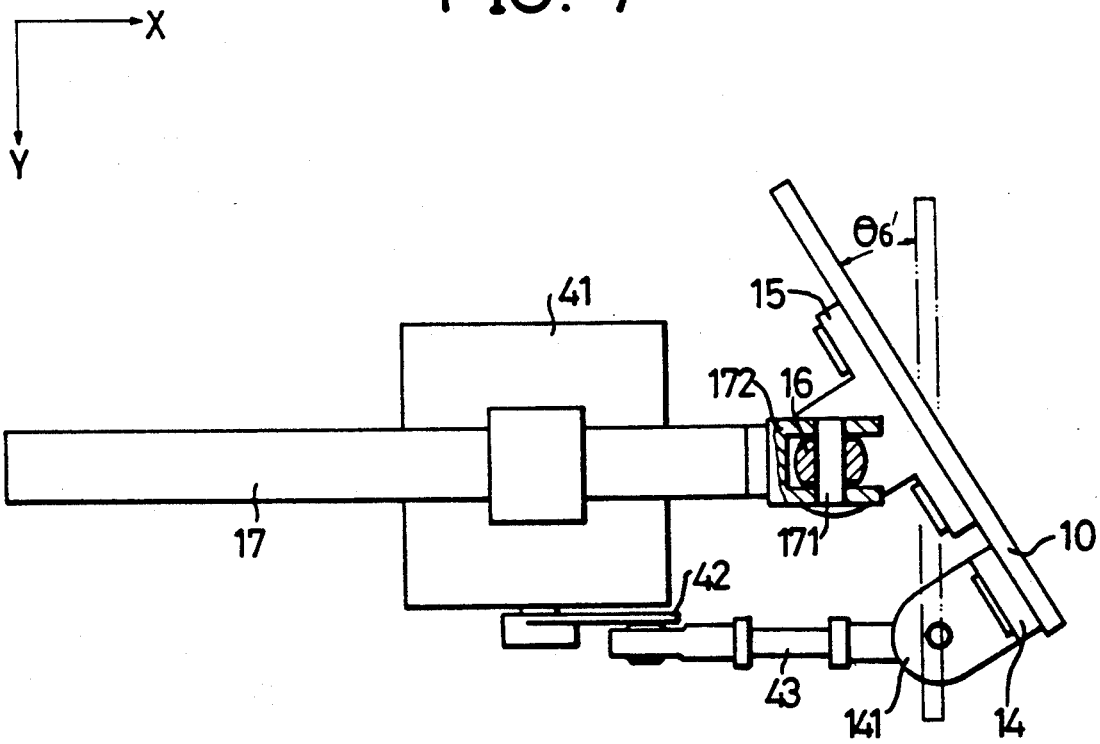
Figure 9:
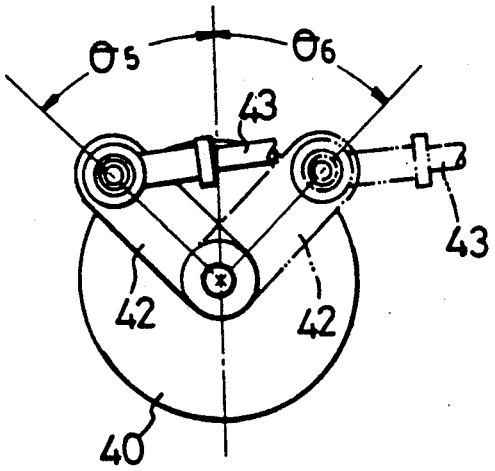
FIG. 9 is a schematic view showing operation of the third driving means in FIGS. 7 and 8.

Referring to FIGS. 7, 8, and 9, under the control of the third motor 40, the movement of the third bar 43 is restricted between a leftmost position shown in FIG. 7 and a rightmost position shown in FIG. 8. When the third motor 40 rotates counterclockwise from a position shown in FIG. 1 through a fifth angle $\theta_5$, the third bar 43 moves to the leftmost position shown in FIG. 7. The mount plate 10 pivot on the X-Y plane about the X-axis to turn the tennis ball shooter leftward through an angle of $\theta_5'$. Accordingly, the tennis ball is served to the left side of the practicer. Again, when a spinning effect is required, the two wheels 12*a* and 12*b* are of different speeds to obtain the required spinning effect. Conversely, when the third motor 40 rotates clockwise from a position shown in FIG. 1 through a sixth angle $\theta_6$, the third bar 43 moves to the rightmost position shown in FIG. 8. The mount plate 10 pivot on the X-Y plane about the Z-axis to turn the tennis ball shoot rightward through an angle of $\theta_6'$. Accordingly, the tennis ball is served to the right side of the practicer. Again, when a spinning effect is required, the two wheels 12 are of different speeds to cause the required spinning effect. The fifth and sixth angles $\theta_5$ and $\theta_6$ can be varied by controlling the third motor 40, and are preferably of 45°. Angles $\theta_5'$ and $\theta_6'$ can be varied in relation to the third bar 43 and the member 42.

It is noted that the invention can be modified without departing the scope and spirit of the invention. For example, the first motor 20 may drive the shaft 17 via a gear train. It is appreciated that the first, second, and third motors 20, 30, and 40 respectively and independently control up and down angles, spinning axes, and left and right angles of tennis balls to be served. Such an arrangement provides a combination which serves almost every possible live shot that may be encountered in an actual competition.

Although the invention has been explained in relation to its preferred embodiment, it is to be understood that many other possible modifications and variations can be made without departing the spirit and scope of the invention as hereinafter claimed.

I claim:

1. A direction-control device for a tennis-ball shooter comprising a mount plate extending on a Y-Z plane on which two motors are mounted on a first side thereof, said motors respectively driving a first wheel and a second wheel provided on a second side of said mount plate opposite to said first side, which together control a speed and a spinning extent of a tennis ball to be served, said direction-control device comprising:

a first bar extending along a Z-axis and having two ends secured to said first side of said mount plate;

a rotatably mounted shaft extending along an X-axis, having a first end engaged to a mediate portion of said first bar and a second end drivably attached to a first driving means, such that said first bar together with said mount plate is pivotable on a Z-X plane about a Y-axis and that said mount plate pivots on a Y-Z plane about said X-axis upon a restricted rotational movement of said first driving means;

a second bar having a first end attached to said first side of said mount plate and a second end drivably attached to a second driving means, such that said mount plate pivots on said Z-X plane about said Y-axis upon a restricted rotational movement of said second driving means, said second driving means being mounted on a first motor seat which is mounted on said shaft to rotate therewith; and a third bar having a first end attached to said first side of said mount plate and a second end drivably attached to a third driving means, such that said mount plate pivots on an X-Y plane about said Z axis upon a restricted rotational movement of said third driving means, said third driving means being mounted on a second motor seat which is mounted on said shaft to rotate therewith.

2. The direction-control device as claimed in claim 1, wherein said mediate portion of said first bar is cut out to form two opposite recesses with a through hole penetrating therethrough, and said second end of said shaft engages with said recesses by means of a pivot pin which extends along said Y-axis passing through said through hole.

3. The direction-control device as claimed in claim 2, wherein said second end of said second bar is attached to said mount plate at a location in alignment with said first bar.

4. The direction-control device as claimed in claim 2, wherein said second end of said third bar is attached to said mount plate at a location in alignment with said pivot pin.

5. The direction-control device as claimed in claim 2, wherein a first transmission member is rigidly mounted to said second end of said shaft at a first end thereof, a second transmission member is in a pivotal connection with a second end of said first transmission member at a first end thereof, and a second end of said second transmission member is attached to an output wheel of said first driving means.

6. The direction-control device as claimed in claim 2, wherein said second driving means has an output shaft and a member is mounted on said output shaft at one end thereof, said second end of said second bar is attached to a distal end of said member.

7. The direction-control device as claimed in claim 2, wherein said third driving means has an output shaft and a member is mounted on said output shaft at one end thereof, said second end of said third bar is attached to a distal end of said member.

* * * * *